US006062309A

United States Patent [19]

Gosse

[11] Patent Number: 6,062,309

[45] Date of Patent: May 16, 2000

[54] TORQUE ROLLER ANCHOR

[75] Inventor: Darryl Gosse, Calgary, Canada

[73] Assignee: Variperm Limited, Canada

[21] Appl. No.: 09/035,040

[22] Filed: Mar. 5, 1998

[30] Foreign Application Priority Data

Jul. 11, 1997 [CA] Canada ..... 2220392

[51] Int. Cl.[7] ..... E21B 23/01

[52] U.S. Cl. ..... 166/216; 166/210; 166/243

[58] Field of Search ..... 166/216, 210, 166/243

[56] References Cited

U.S. PATENT DOCUMENTS

| | | | |
|---|---|---|---|
| 2,737,245 | 3/1956 | Knox . | |
| 3,102,592 | 9/1963 | Dollison . | |
| 3,437,136 | 4/1969 | Young . | |
| 3,526,277 | 9/1970 | Scott . | |
| 3,599,712 | 8/1971 | Magill . | |
| 3,887,006 | 6/1975 | Pitts . | |
| 5,119,875 | 6/1992 | Richard . | |
| 5,275,239 | 1/1994 | Obrejanu | 166/210 |
| 5,623,991 | 4/1997 | Jani | 166/216 |
| 5,636,690 | 6/1997 | Garay | 166/216 |
| 5,771,970 | 6/1998 | Jani | 166/216 |

FOREIGN PATENT DOCUMENTS

| | | |
|---|---|---|
| 371318 | 1/1938 | Canada . |
| 933089 | 9/1973 | Canada . |
| 1274470 | 9/1990 | Canada . |
| 2077990 | 11/1995 | Canada . |
| 2162409 | 5/1997 | Canada . |
| 2188175 | 5/1997 | Canada . |

OTHER PUBLICATIONS

Varipharm Product 167 TQ Anchor—vol. 2, Dec. 1995, Canada, Published by: World Oil.

Brown Oil Tools, Inc., 1966–67, Canada.

*Primary Examiner*—David Bagnell
*Assistant Examiner*—Chris H. Kang
*Attorney, Agent, or Firm*—Cox & Smith Incorporated

[57] ABSTRACT

A mandrel-operated torque roller anchor for insertion into the casing of a well, which when set resists axial movement and prevents rotation of itself and the string above it in one direction, but permits such motion when rotated in the other direction. The anchor comprises a central mandrel and a slip cage. The slip cage has a number of elongated slots. A number of drag slips rest on the mandrel within the slip cage and provide limited outward movement, through the slots, to bear against the casing. Each drag slip has a surface with wickers to grip the casing and set the anchor, and an adjacent unwickered drag portion to bear against the casing to allow the mandrel to rotate relative to the slips and cage, but permit axial movement of the string. Slots running through the drag portion of the slip provide flow around the anchor. Biasing elements extend between the mandrel and an interior surface of each slip to force the drag portion of the corresponding slip against the casing when in an unset position. Rollers are carried in axial grooves on the external surface of the mandrel and in an unset position are held by and positioned beneath the cage. In a set position the rollers are oriented beneath, and cause to pivot against the biasing elements, the wickered surfaces, to set the anchor. Components on the mandrel and cage limit rotative movement of the mandrel with respect to the cage between set and unset positions.

5 Claims, 5 Drawing Sheets

TORQUE ROLLER ANCHOR

FIELD OF THE INVENTION

The present invention relates to a well tubing string anchor, and more particularly to an improved drag slip activation system for such anchors which provides additional flow bypass capability.

BACKGROUND OF THE INVENTION

Conventional anchors used in oil wells for supporting pumps or the like within the well casing incorporate a tubular anchor frame, a slip cage secured to the frame and a plurality of slips having cam and follower surfaces or conical surfaces, the slips actuable by appropriate mechanisms to force them outwardly into anchoring position by engagement with the walls of the casing. That actuation is generally accomplished by a rotary action on the drill string above the anchor frame, to which the anchor frame is attached, which rotary action causes a drive means to operate the anchor slips. In Canadian Patent No. 2,077,990, of Jani et al. issued Nov. 21, 1995, that action is accomplished by means of rotation of a mandrel associated with the anchor, in one direction, so as to cause movement of drive cones into position beneath the slips, forcing the slips outwardly into anchoring position against the casing walls. Rotation of the mandrel in the other direction moves the drive cones away from position beneath the slips to free the slips from anchoring engagement on the casing walls.

Another reference of general background interest to the present invention is Canadian Patent No. 1,274,470 of Webber issued Sep. 25, 1990 which teaches an oil pumping apparatus incorporating a rotary pump on a production tubing string, in the form of a rotary pump having a stator and screw type rotor, with a no turn tool secured to the stator to prevent right-hand rotation of the stator while permitting vertical movement of a stationary means associated with the stator. Other references of general background interest include U.S. Pat. No. 2,737,245 issued Mar. 6, 1956 of Knox, U.S. Pat. No. 3,102,592 issued Sep. 3, 1963 of Dollison, U.S. Pat. No. 3,887,006 issued Jun. 3, 1975 of Pitts, Canadian Patent No. 371,318 issued Jan. 18, 1938 of Clark, Canadian Patent Application No. 2,162,409 published May 9, 1997 of Jani and Canadian Patent Application No. 2,188,175 published May 9, 1997 to Jani. These latter two Jani references teach convex wedge-like surfaces supported on the mandrel rotatable into position beneath the drag slips and to cause the slips to move outwardly into set position.

SUMMARY OF THE INVENTION

In accordance with the present invention there is provided a mandrel-operated torque roller anchor for insertion into the casing of a well, when set to prevent or resist axial movement of a tubing and prevent rotation of itself and any part of the string located above it in one direction but permit rotation of it and any part of the string located above it, as well as axial motion, when rotated in the other direction. The anchor comprises a centrally disposed elongated mandrel and a slip cage mounted externally on the mandrel for limited relative rotative movement with respect thereto. The slip cage has multiple elongated slots when viewed from the side. A plurality of drag slips resting externally on the mandrel within the slip cage for relative, limited outward movement relative thereto through the slots in the slip cage to bear against an interior wall of the casing. The drag slips each have an exterior surface, one portion of which is provided with wickers to grip the interior wall of the casing so as to set the anchor, an adjacent, lateral, smooth unwickered drag portion to bear against the interior wall of the casing so as to allow the mandrel to be rotated relative to the slips and cage but permit axial movement of the tubing string, slots running through the drag portion of the slip to provide additional flow bypass capability around the anchor, and a fulcrum between those two portions. Biasing means extend between a portion of the exterior surface of the mandrel and an interior surface of each slip beneath the drag portion to force the drag portion of the corresponding slip outwardly against the casing wall when the mandrel and slip cage are in unset position. A plurality of elongated rollers are carried in axial grooves in the external surface of the mandrel in a manner so that, in unset position, the rollers are positioned beneath, and held in position in their corresponding grooves by, interior surfaces of the cage walls, and in set position the rollers are oriented beneath and cause to pivot outwardly against the biasing means the wickered surface portions so as to set the anchor in position. Means are associated with the mandrel and the slip cage so as to limit relative rotative movement of the mandrel with respect to the slip cage between set and unset positions.

In a preferred embodiment of the present invention the biasing means for each slip is a leaf spring. As well, the smooth portions of each slip are provided with axially extending grooves that act as fluid by-pass areas. The means to limit the rotation of the slip cage relative to the mandrel preferably comprises a retainer ring rigidly associated with the slip cage and provided with slots within which travel projection means secured and outwardly extending from the surface of the mandrel.

The anchor according to the present invention provides a novel, but simple and effective construction for preventing the tubing string, to which the anchor is attached, from axial movement, when in set position. It may be set by a simple, right-hand, limited turn of the tubing string above the anchor. Release of the anchor is achieved through the retraction of the slips by a reverse turning of the mandrel.

It is thus an object of the invention to provide an activation system for drag slips which is unique and will, under many conditions, be advantageous in operation over conventional known anchor systems.

BRIEF DESCRIPTION OF THE DRAWINGS

These and other advantages of the invention will become apparent upon reading the following detailed description and upon referring to the drawings in which.

Figure 1:
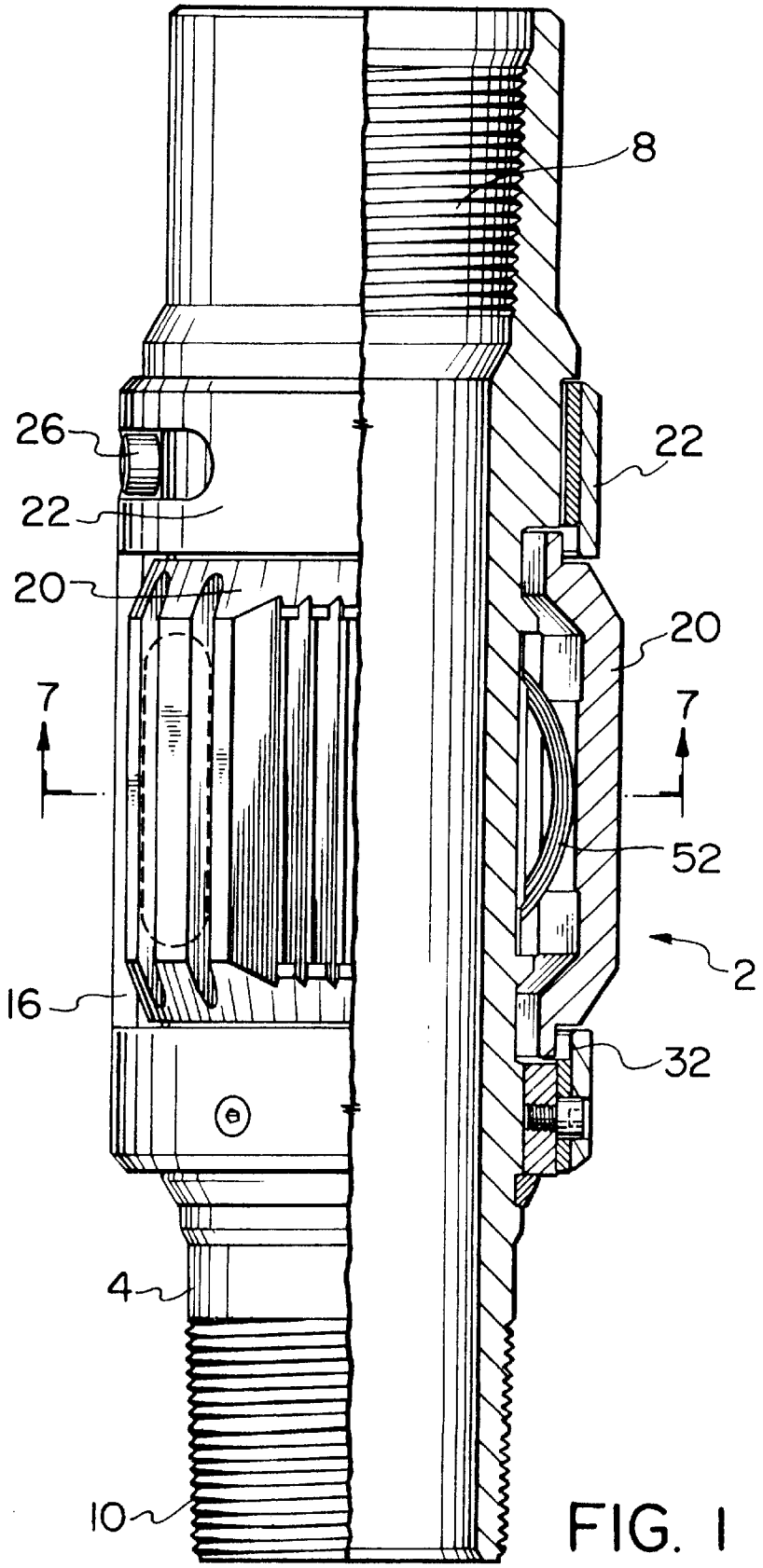
FIG. 1 is a front elevation, in partial section, of an anchor according to the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings similar features have been given similar reference numerals.

Figure 2:
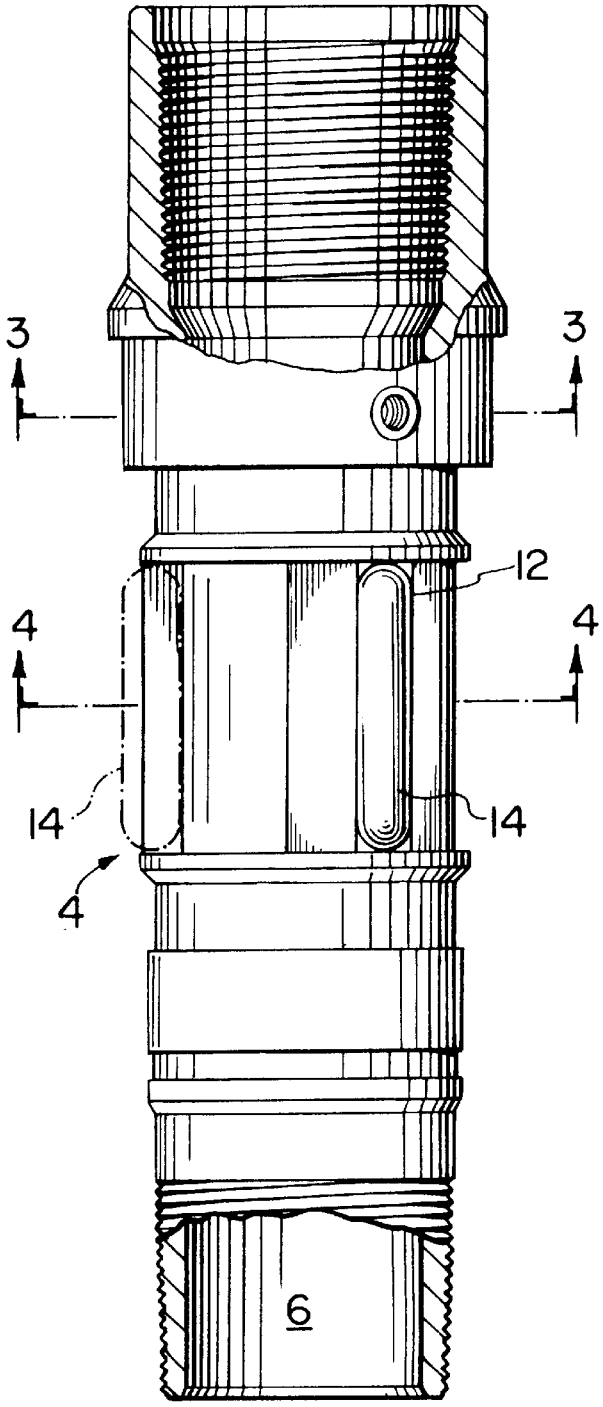
FIG. 2 is a front elevation, in partial section, of the mandrel according to the present invention, with the slip cage removed, showing the positioning of the rollers.
Figure 4:
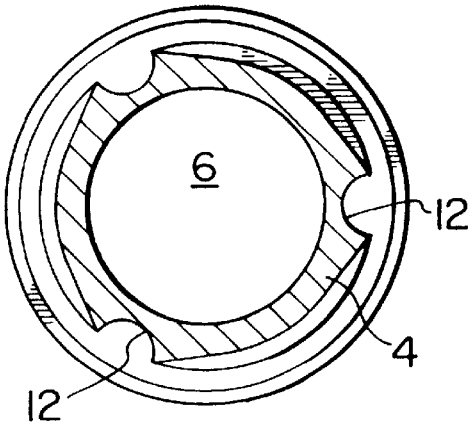
FIGS. 3 and 4 are respectively section views of the mandrel along lines 3—3 and 4—4 of FIG. 2.
Figure 3:
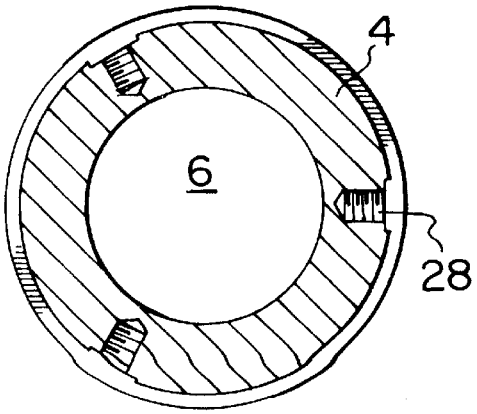

Turning to FIG. 1 there is illustrated an example embodiment of anchor 2. Anchor 2 includes a tubular mandrel 4 having a central passage 6 there through, with box threads 8 at the top and pin threads 10 at the bottom, for connection to it of parts of the tubing string, above and below. Drill string and tubing string generally refer to two different applications in the oil industry. This tool is usually associated with tubing strings but can be adapted to be used in a drilling application. As can be seen in FIGS. 2 and 4, mandrel 4 is provided with three axially extending concave bearing surfaces 12, which, when viewed from the side (FIG. 2) appear obround. Within each is seated, as will be described in more detail subsequently, an elongated roller 14 having a circular cross-section and convex-shaped ends as illustrated.

Seated on the exterior surface of mandrel 4 is slip cage 16. It has multiple openings or windows 18 which, when viewed from the side, are rectangular in appearance and are oriented with their long side running axially. Through each opening extends a slip 20.

Figure 5:
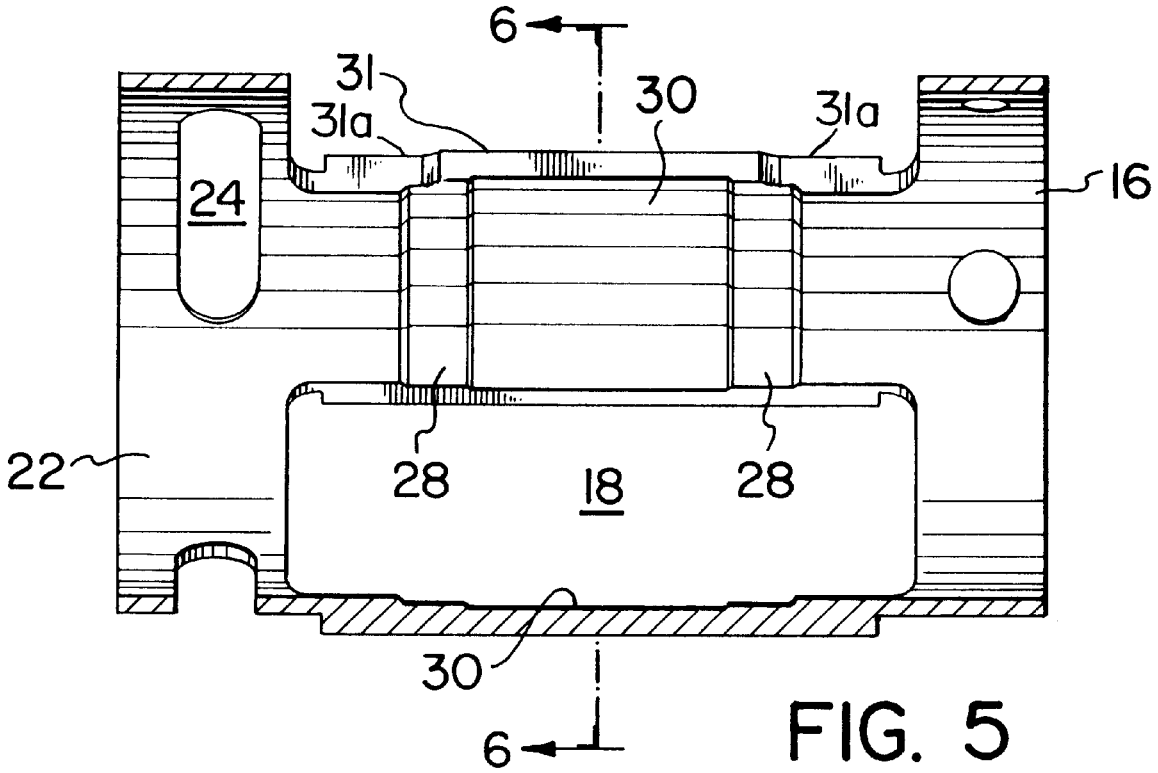
FIG. 5 is a section view of a slip cage, separate from the mandrel.
Figure 6:
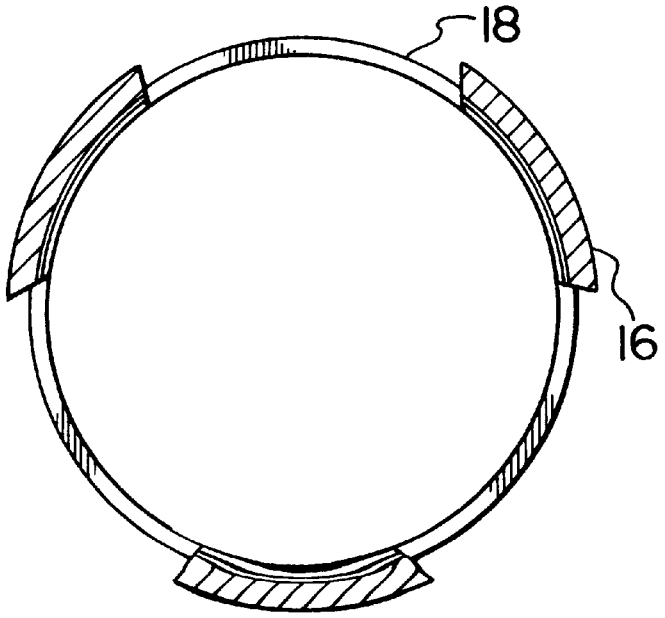
FIG. 6 is a section view of a slip cage along line 6—6 of FIG. 5.
Figure 7:
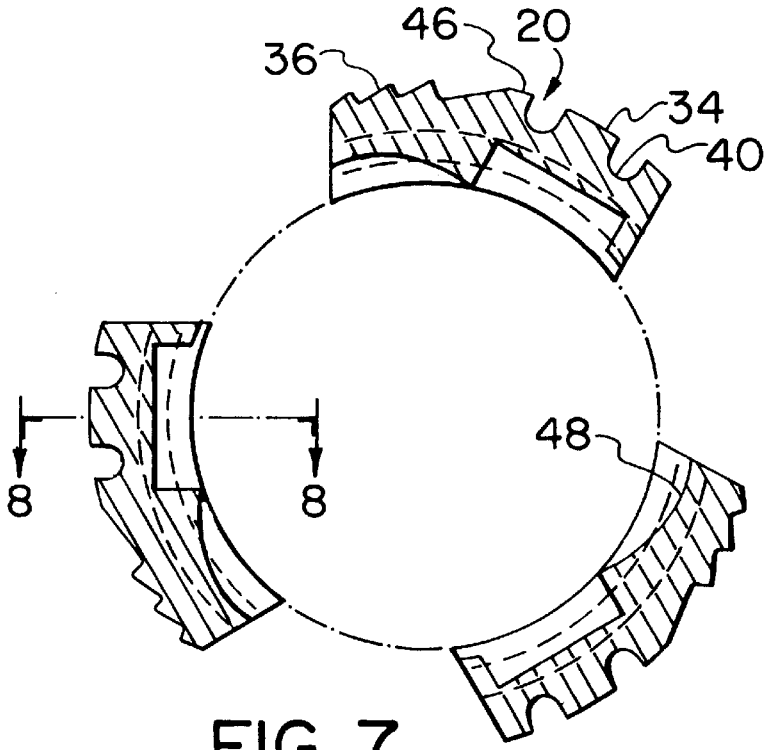
FIG. 7 is a section view of the slips of the invention, along line 7—7 of FIG. 1.
Figure 8:
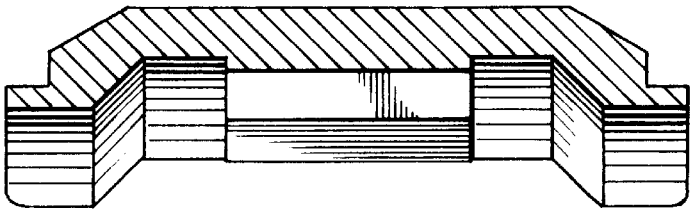
FIG. 8 is a partial view, from the inner surface, of one of the slips of FIG. 7.

A retainer ring 22 is secured to or forms part of one end of slip cage 16 as illustrated (FIGS. 1 and 5). Retainer ring 22 is provided with three slots 24 spaced about its periphery. These slots 24 receive and restrict the relative movement of cap screws 26 in the exterior surface of mandrel 4. In this way the relative rotative movement of slip cage 16 and slips 20 on mandrel 4 is limited, for example to a maximum of 45 degrees rotation around the mandrel. The amount of relative rotation can be adjusted by the length of these slots. A longer slot will provide a greater rotational capability. Relative axial movement of slip cage and slips 20 on mandrel 4 is prevented by this slot and cap screw arrangement.

The interior surfaces of slip cage 16 are provided with stepped bearing surfaces 28 and stepped by-pass or flow surfaces 30 as illustrated. The bearing surfaces act to maintain the rollers in their proper orientation. The flow surfaces provide areas where sand can pass through the caged assembly without impacting the roller action, thus allowing the rollers to perform properly. The slip cage windows 18 have been designed on the setting side of each window with an extension 31 that enables smoother transition of the roller from set to the unset position. The time that the roller spends being supported by the mandrel only is limited by the use of this extension. The cutaway areas 31*a* enable fluid to wash through the window between the slip and the cage. This will aid the tool when sand has worked its way under the slip. By washing around the tool fluid can more easily passed between the slip and the cage carrying the sand with it.

Retainer ring 22, as well as a second retaining ring 32 secured to slip cage 16, act to hold upper and lower ends of drag slips 20 within slip cage 16, in operative position.

Figure 9:
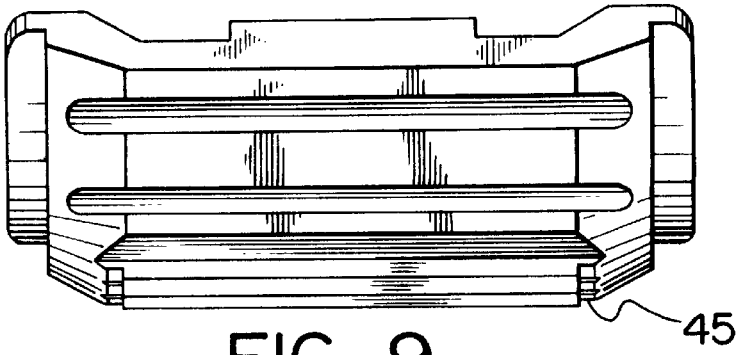
FIG. 9 is a perspective view, from the outside, of one of the slips of FIG. 7.

As can be seen in FIGS. 1, 7, 10 and 11, drag slips 20 each have an outer surface comprising two adjacent, axially extending portions or sections 34 and 36. Section 34 functions as a drag area and is generally rounded to conform to the inner wall of the casing 38 (FIG. 10) and having axially extending grooves 40 provided to maximize the annulus area 42 between the inner surface of the casing and the outer surfaces of anchor 2. This larger annulus area is an important part of the tool according to the present invention, since it enables maximization of this area. The other section 36 is provided with wickers 36, which for example may be axially cut, to grip the inner casing surface when anchor 2 is in set position. As can be seen in FIG. 9, a notch 45 radially cut at the ends of wickers 36 will restrict axial movement of the tool when it is set. Between these two sections is a fulcrum 46, the function of which will be described in more detail subsequently.

On the underside of the slips 20 is located a concave surface 48 which serves to accomplish two things. As the roller 14 passes from the extension of the bearing surface of the cage it passes underneath a beginning of a concave surface 48. This ensures a smooth transition and maintains the proper alignment of the roller by proving support for the roller underneath by the mandrel and on top by the concave surface. As the roller is positioned further underneath the slip the concave surface provides a means to increase the pressure that the setting wickers can apply to the casing wall.

On the direct underside of the drag section is a notched flat surface 50. Leaf springs 52 (preferably a set of five, as illustrated) are seated between surface 50 and a portion of the exterior surface of mandrel 4, so that in normal, unset position, the corresponding drag slip 20 is forced outwardly through its corresponding opening 18 in slip cage 16, to contact the inner wall of casing 38. These springs are always in a loaded state.

Figure 10:
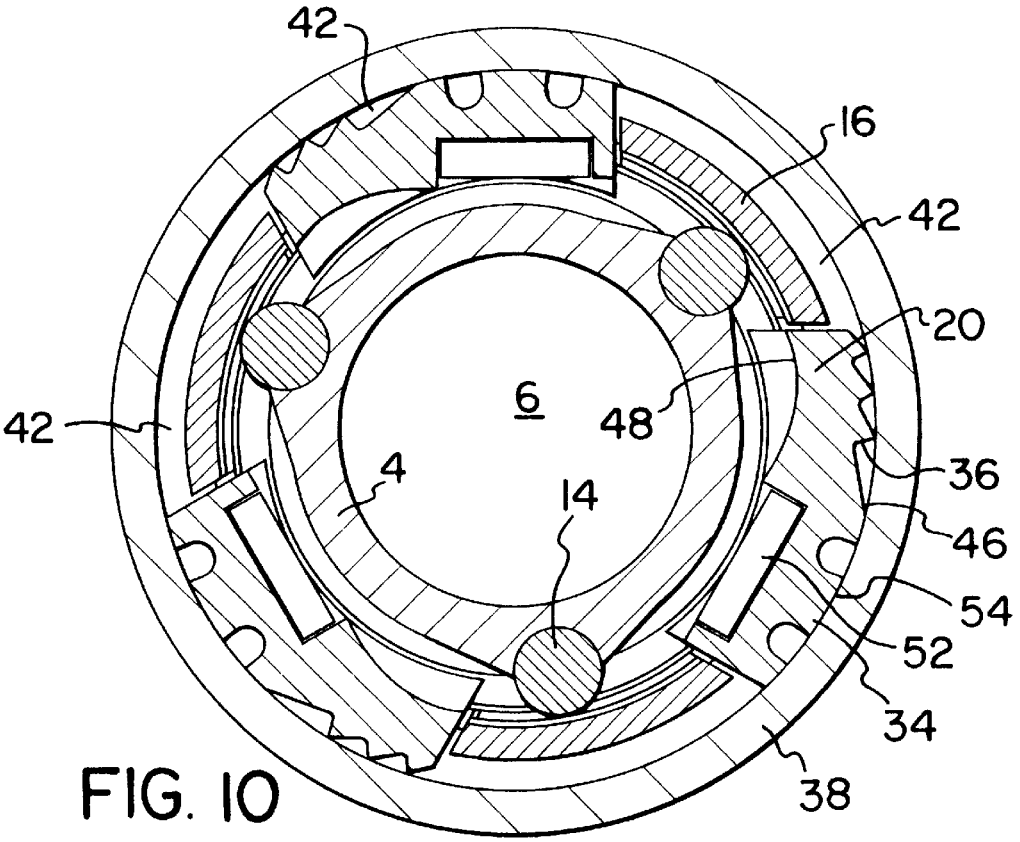
FIGS. 10 and 11 are section views along line 7—7 of FIG. 1 looking down the tool, respectively, in set position and unset position.
Figure 11:
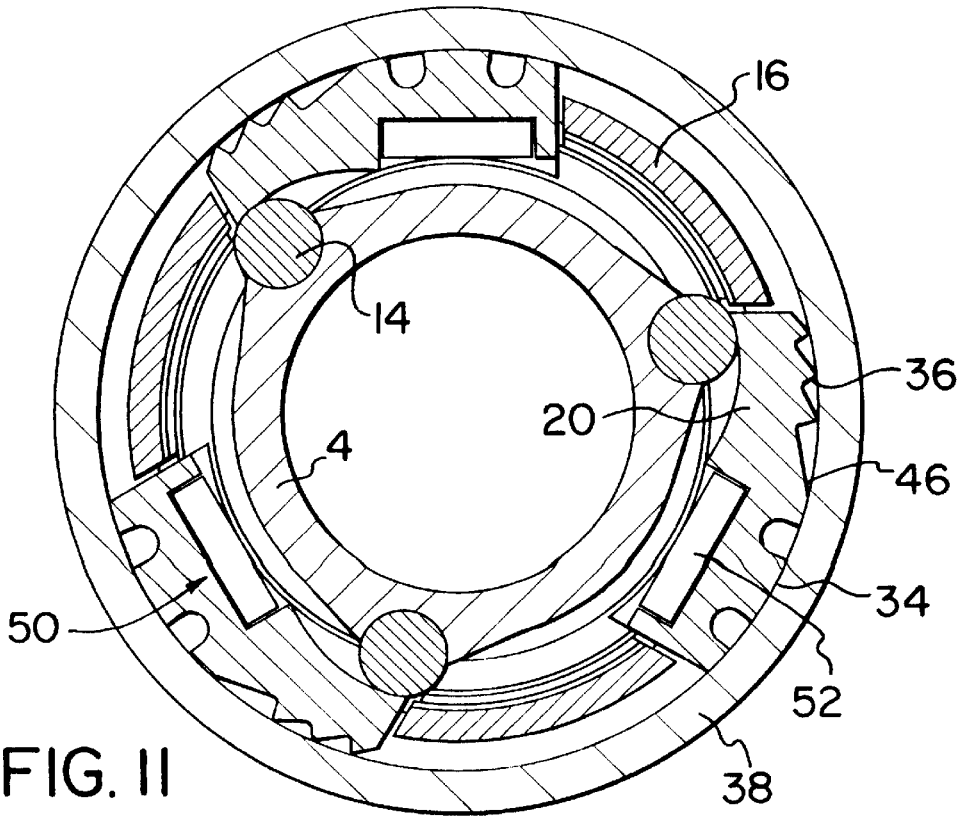

The operation of the anchor is illustrated in FIGS. 9 and 10. In unset position, looking down casing 38 within which anchor 2 has been positioned, mandrel 4 is oriented, with respect to slip cage 16, so that rollers 14 rest against stepped bearing surfaces 28 on the interior surfaces of slip cage 16. In this orientation, springs 52 result in their normal forces to be applied directly between the fluid by-pass grooves 40. This normal force ($F_N$) results in friction at the contact surface 54 of slip cage 16 shown in FIG. 10. With a right-hand rotation of about 45 degrees or less, of mandrel 4 with respect to slip cage 16, rollers 14 move over to and bear against the accepting sections 48 of their adjacent slips 20, causing those slips to pivot or rock with respect to fulcrum 46 so that wicker sections 36 move outwardly to engage with the inner wall of casing 38, thereby immobilizing and setting anchor 2 in position. When in this set position, these springs 52 remain in a loaded state, but there is no longer any contact at surface 54 between the fluid by-pass grooves 40. The contact points are now the edges of the wickers.

By rotating the mandrel to the left, the slips 20 pivot in the other direction, about fulcrum 46, so that drag sections 34 instead of wicker sections 36 engage the casing wall, enabling anchor 2 to be directly pulled out of casing 38 or pushed through.

Thus, it is apparent that there has been provided in accordance with the invention an improved anchor for tubing strings that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

THE EMBODIMENTS OF THE INVENTION IN WHICH AN EXCLUSIVE PROPERTY OR PRIVILEGE IS CLAIMED ARE DEFINED AS FOLLOWS:

I claim:

1. A mandrel operated tension torque anchor for insertion into the casing of a well, when set to prevent or resist axial movement of a tubing string and prevent rotation of itself and any part of the string located above it in one direction but permit rotation of it and any part of the string located above it, as well as axial motion, when rotated in the other direction, the anchor comprising:

(a) a centrally disposed elongated mandrel;

(b) a slip cage resting externally on the mandrel for limited relative rotative movement with respect thereto, the slip cage having multiple elongated slots when viewed from the side;

(c) a plurality of drag slips mounted externally on the mandrel within the slip cage for limited outward movement relative thereto through the slots in the slip cage to bear against an interior wall of the casing, the drag slips each having an exterior surface, one portion of which is provided with wickers to grip the interior wall of the casing so as to set the anchor, an adjacent, lateral, smooth unwickered drag portion to bear against the interior wall of the casing but permit axial movement of the tubing string, slots running through the drag portion of the slip to provide additional flow bypass capability around the anchor, and a fulcrum between those two portions;

(d) biasing means extending between a portion of the exterior surface of the mandrel and an interior surface of each slip beneath the drag portion to force the drag portion of the corresponding slip outwardly against the casing wall when the mandrel and slip cage are in unset position;

(e) a plurality of elongated rollers carried in axial grooves in the external surface of the mandrel in a manner so that, in unset position, the rollers are positioned beneath, and held in position in their corresponding grooves by, interior surfaces of the cage walls, and in set position the rollers are oriented beneath and cause to pivot outwardly against the biasing means, the wickered surface portions so as to set the anchor in position, and (f) means associated with the mandrel and the slip cage to limit relative rotative movement of the mandrel with respect to the slip cage between set and unset positions.

2. An anchor according to claim 1 wherein the biasing means for each slip is a leaf spring means.

3. An anchor according to claim 2 wherein the smooth portions of each slip are provided with axially extending grooves that act as fluid by-pass areas.

4. An anchor according to claim 1 wherein the means to limit the rotation of the slip cage relative to the mandrel comprises a retainer ring rigidly associated with the slip cage and provided with slots within which travel projection means secured to and outwardly extending from the surface of the mandrel.

5. An anchor according to claim 4 wherein the projection means comprise cap screws secured to the surface of the mandrel and positioned so as to travel within the retainer ring slots to thereby limit relative movement of the slip cage with respect to the mandrel.

* * * * *